US011705636B2

(12) United States Patent
Tu et al.

(10) Patent No.: US 11,705,636 B2
(45) Date of Patent: Jul. 18, 2023

(54) COMPOSITE ANTENNA UNIT AND ARRAY ANTENNA USING THE SAME

(71) Applicant: QuantumZ Inc., Kaohsiung (TW)

(72) Inventors: Kun-Yen Tu, Kaohsiung (TW); Meng-Hua Tsai, Kaohsiung (TW); Wei-Ting Lee, Kaohsiung (TW); Sin-Siang Wang, Kaohsiung (TW)

(73) Assignee: QUANTUMZ INC., Kaohsiung (TW)

( * ) Notice: Subject to any disclaimer, the term of this patent is extended or adjusted under 35 U.S.C. 154(b) by 4 days.

(21) Appl. No.: 17/586,695

(22) Filed: Jan. 27, 2022

(65) Prior Publication Data

US 2022/0407232 A1 Dec. 22, 2022

(30) Foreign Application Priority Data

Jun. 22, 2021 (TW) ..... 110122793

(51) Int. Cl.
*H01Q 21/06* (2006.01)
*H01Q 9/04* (2006.01)
*H01Q 1/24* (2006.01)

(52) U.S. Cl.
CPC ..... *H01Q 9/0414* (2013.01); *H01Q 9/045* (2013.01); *H01Q 1/243* (2013.01); *H01Q 21/065* (2013.01)

(58) Field of Classification Search
CPC ..... H01Q 9/0414; H01Q 9/045; H01Q 1/243; H01Q 21/065; H01Q 9/0457
See application file for complete search history.

(56) References Cited

U.S. PATENT DOCUMENTS 5,661,493 A * 8/1997 Uher ..... G01S 13/89 343/770

FOREIGN PATENT DOCUMENTS

| | | | |
|---|---|---|---|
| CN | 111653868 A | | 9/2020 |
| CN | 110571508 B | | 7/2021 |
| JP | 2003298339 A | * | 10/2003 |
| TW | M584026 U | | 9/2019 |

* cited by examiner

*Primary Examiner* — Dieu Hien T Duong
(74) *Attorney, Agent, or Firm* — Leong C. Lei

(57) ABSTRACT

A composite antenna and array antenna using the same. The antenna has a three-layer structure including a patch antenna, a slot antenna and a transmission line. A first layer includes a patch antenna resonating at half a wavelength, a second layer includes a slot antenna resonating at half the wavelength, and a third layer includes a transmission line and a feed point. The three layers are coupled and the entire composite antenna unit satisfies a resonance condition. A signal is fed through the transmission line and coupled to the slot antenna, and the signal from the slot antenna is further coupled to the patch antenna. This composition antenna has a desirable antenna gain, and an increased antenna bandwidth compared to a single patch antenna or slot antenna.

15 Claims, 8 Drawing Sheets

COMPOSITE ANTENNA UNIT AND ARRAY ANTENNA USING THE SAME

CROSS-REFERENCE TO RELATED APPLICATION

This application claims the benefit of Taiwan Patent Application No. 110122793, filed on Jun. 22, 2021, which is hereby incorporated by reference for all purposes as if fully set forth herein.

BACKGROUND

Technical Field

The present invention relates to wireless communication technologies, in particular to a composite antenna unit and an array antenna using the same having an increased bandwidth coverage.

Related Art

With development of mobile communication technologies, electronic products such as cell phones, PADs, notebooks, and other portable devices are becoming indispensable in our lives. Antenna system for communication is also becoming essential for such electronic devices. However, ever increasing demands for transmission speed and capacity have driven the use of a new frequency band for higher transmission speed and a larger transmission data volume into a GHz frequency spectrum—a millimeter wave region. Therefore, a millimeter wave is the next generation mainstream communication technology, also known as 5G.

5G is a research and development focus globally. A millimeter wave antenna with a high carrier frequency and a wide bandwidth range is essential for achieving a 5G ultra high data transmission rate. Such millimeter wave antenna needs to be designed with high gain and directivity. However, existing single patch antenna or single slot antenna has a shortfall of smaller bandwidth.

In addition, existing flame retardant 4 (FR4) substrate is used for frequencies below 10 GHz, but not adequate for millimeter wave antenna designs due to excessive losses.

SUMMARY

The present invention provides a composite antenna unit having a wide bandwidth coverage to alleviate the problem of small bandwidth. A composite architecture of patch antenna and slot antenna is utilized, so that the problem of excessively small bandwidth of a single patch antenna or a single slot antenna is significantly improved.

The present invention further provides an array antenna having a substrate made of a liquid crystal polymer (LCP) material and a composite architecture of patch antenna and slot antenna. The LCP material has characteristics of low loss, low water absorption and good malleability that are desirable for millimeter wave antenna design.

The present invention provides a composite antenna unit including: a first substrate having an upper surface and an opposite lower surface, a patch antenna disposed on the upper surface of the first substrate, a second substrate having an upper surface and an opposite lower surface and a blind hole used as a feed point, a slot antenna formed in a metal layer disposed between the upper surface of the second substrate and the lower surface of the first substrate, and a transmission line disposed on the lower surface of the second substrate corresponding to the blind hole to couple and feed to the slot antenna. The patch antenna and slot antenna respectively resonates at half the wave length. The entire composite antenna unit satisfies a resonance condition through coupling. A signal is fed through the transmission line and coupled to the slot antenna, and the signal from the slot antenna is further coupled to the patch antenna.

The slot of the slot antenna is substantially perpendicular to the direction of the transmission line.

The patch antenna may also include two patch antenna units resonating at half the wavelength and a line segment connecting the two patch antenna units, where a position of the line segment is aligned with an edge of the slot of the slot antenna.

Each patch of a patch antenna has shapes of a square, a rectangle, a circle, a oval, a triangle, a sector, a ring, a ring sector or other similar shapes.

The transmission line and the slot antenna are coupled at a position 0.26 times the wavelength distant from the center of the slot.

The first substrate and the second substrate are made of LCP.

The present invention further provides a composite array antenna. The composite array antenna includes an array antenna using the above mentioned composite antenna unit. The arrayed antenna has an overall thickness of 400 μm and an operation frequency band ranged from 27.4 GHz to 30 GHz.

The arrayed antenna includes a one-to-many feed network and is on the same layer as the transmission line.

The metal layer of the slot antenna is used as a reference ground, a plurality of blind holes are formed on the second substrate to allow coupling between the metal layer and the feed network. A metal surface is disposed on the same layer of the feed network to serve as an extension of the reference ground.

The composition antenna of present invention has advantages of higher gain and wider bandwidth. The antenna unit utilizes the composite architecture of patch antenna and slot antenna that can alleviate the problem of an excessively small bandwidth of a single patch antenna or a single slot antenna. The antenna has also provides a desirable antenna gain, and has an increased antenna bandwidth compared to an existing single patch or slot antenna.

The present invention further provides an array antenna ranged from 27.4 GHz to 30 GHz by combining patch antenna and the slot antenna. The frequency band is determined by the patch antennae, slot antennae, and a coupling path therebetween, so that the bandwidth can be increased to make up for insufficient bandwidths of a single patch antenna or a single slot antenna. The antenna substrate is made of the liquid crystal polymer (LCP). The LCP material has characteristics of low loss and low water absorption that are desirable for millimeter wave antenna design. The composition antenna has a center frequency of 28.69 GHz, a bandwidth of 8.78%, and a desirable return loss. The gain of the arrayed antenna can reach 10.7 dBi.

DETAILED DESCRIPTION

Embodiments of the present invention are described in detail as follows with reference to drawings. The accompanied drawings are simplified schematic diagrams, which are merely used for illustrating basic structures of the present invention. Therefore, only elements related to the present invention are indicated in these drawings. The elements that are not drawn based on a quantity, a shape, a size ratio, and the like during implementation. Actual specifications and dimensions during the implementation are actually selectively designed, and a layout of the elements may be more complicated.

Descriptions of the following embodiments are provided with reference to the attached drawings to illustrate specific embodiments of the present invention that may be implemented accordingly. Direction terms such as "upper", "lower", and the like mentioned in the present invention are merely directions for reference to the attached drawings. Therefore, the direction terms that are used are used for describing and understanding this application, rather than limiting this application. In addition, in the specification, unless expressly described to the contrary, the word "include" is to be understood as including described elements without excluding any other elements.

Figure 1:
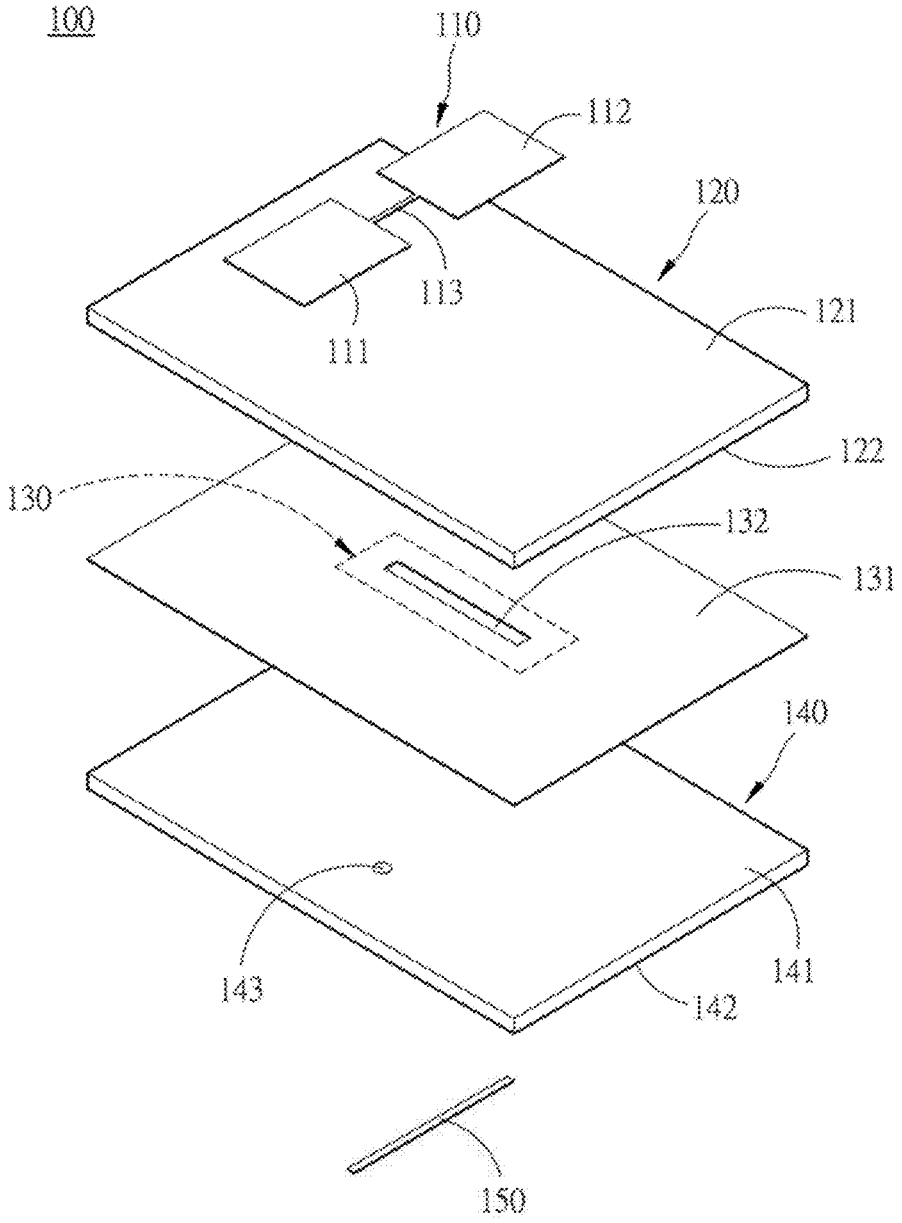
FIG. 1 is a three-dimensional schematic structural exploded view of a composite antenna unit according to the present invention.
Figure 2:
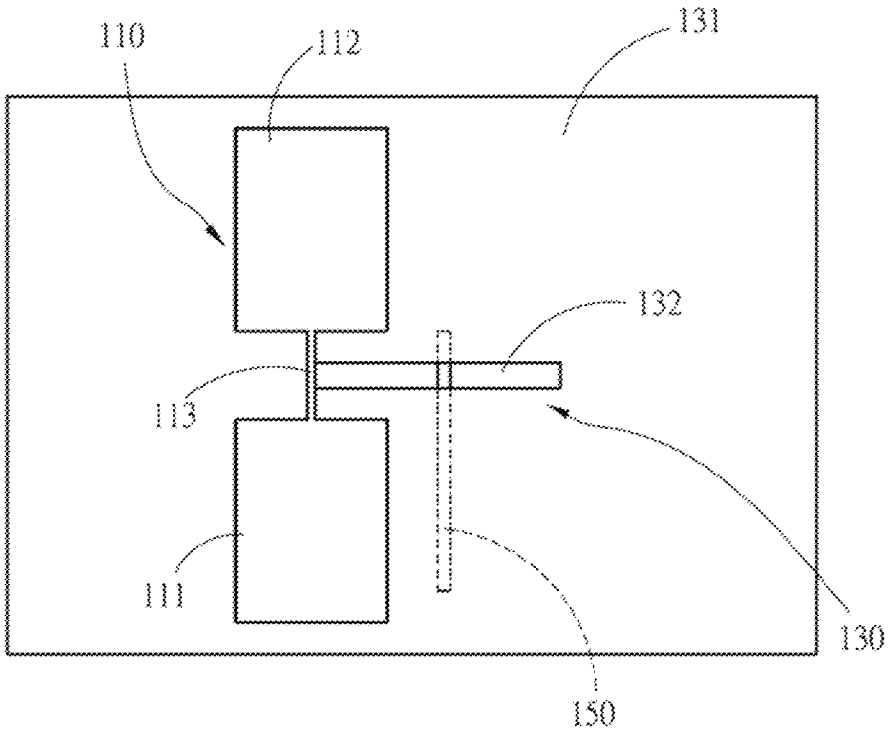
FIG. 2 shows a composite structure and a stacked diagram of the composite antenna unit according to the present invention.

FIG. 1 is a three-dimensional schematic structural exploded view of a composite antenna unit according to the present invention, and FIG. 2 shows a composite structure and a stacked diagram of the composite antenna unit according to the present invention where substrates are removed. The composite antenna unit 100 according to the present invention includes: a first substrate 120 having an upper surface 121 and a lower surface 122 opposite to the upper surface 121, a patch antenna 110 disposed on the upper surface 121 of the first substrate 120, a second substrate 140 having an upper surface 141, a lower surface 142 opposite to the upper surface 141, and a blind hole 143 as a feed point, a slot antenna 130, formed by providing a slot 132 on a metal layer 131 disposed between the upper surface 141 of the second substrate 140 and the lower surface 121 of the first substrate 120, and a transmission line 150 disposed on the lower surface 142 of the second substrate 140. The patch antenna 110 and the slot antenna 130 respectively resonates at half the wavelength. The transmission line 150 corresponds to the blind hole 143 and is configured to couple with and feed signal to the slot antenna 130. The slot 132 and the transmission line 150 are substantially perpendicular to each other. The entire composite antenna unit 100 satisfies a resonance condition by means of coupling. A signal is fed through the transmission line 150 and coupled to the slot antenna 130, and the signal from the slot antenna 130 is further coupled to the patch antenna 110.

In this embodiment, the patch antenna 110 includes two patch antenna units 111 and 112 resonating at half the wavelength and a line segment 113 connecting the two patch antenna units 111 and 112. The position of the line segment 113 is aligned with an edge of the slot 132 in the slot antenna 130. The patch antenna units 111 and 112 are rectangle in this embodiment, but they may also have shapes of square, circle, oval, triangle, sector, ring, ring sector, or other similar shapes.

In this embodiment, the signal feed of the transmission line 150 is coupled to the slot antenna 130 at a position 0.26 times the wavelength distant from the center of the slot 132.

The first substrate 120 and the second substrate 140 may be made of epoxy resin, polyphenylene oxide, fluorine resin, or liquid crystal polymer (LCP). LCP is used in this embodiment. Liquid crystal polymer material has characteristics of low loss, low water absorption, and high malleability that are desirable in high-frequency antenna design.

The composite antenna unit 100 in this embodiment is a combination of a patch antenna 110 and a slot antenna 130, which has a three layer structure with a thickness of 400 μm. The first layer is the patch antenna 110 resonating at half a wavelength, the second layer is the slot antenna 130 resonating at half the wavelength, and the third layer is a transmission line 150. The composite antenna unit 100 satisfies a resonance condition by means of coupling. A signal is fed in the third layer and coupled to the second layer, and the signal from the second layer is further coupled to the first layer.

Figure 3:
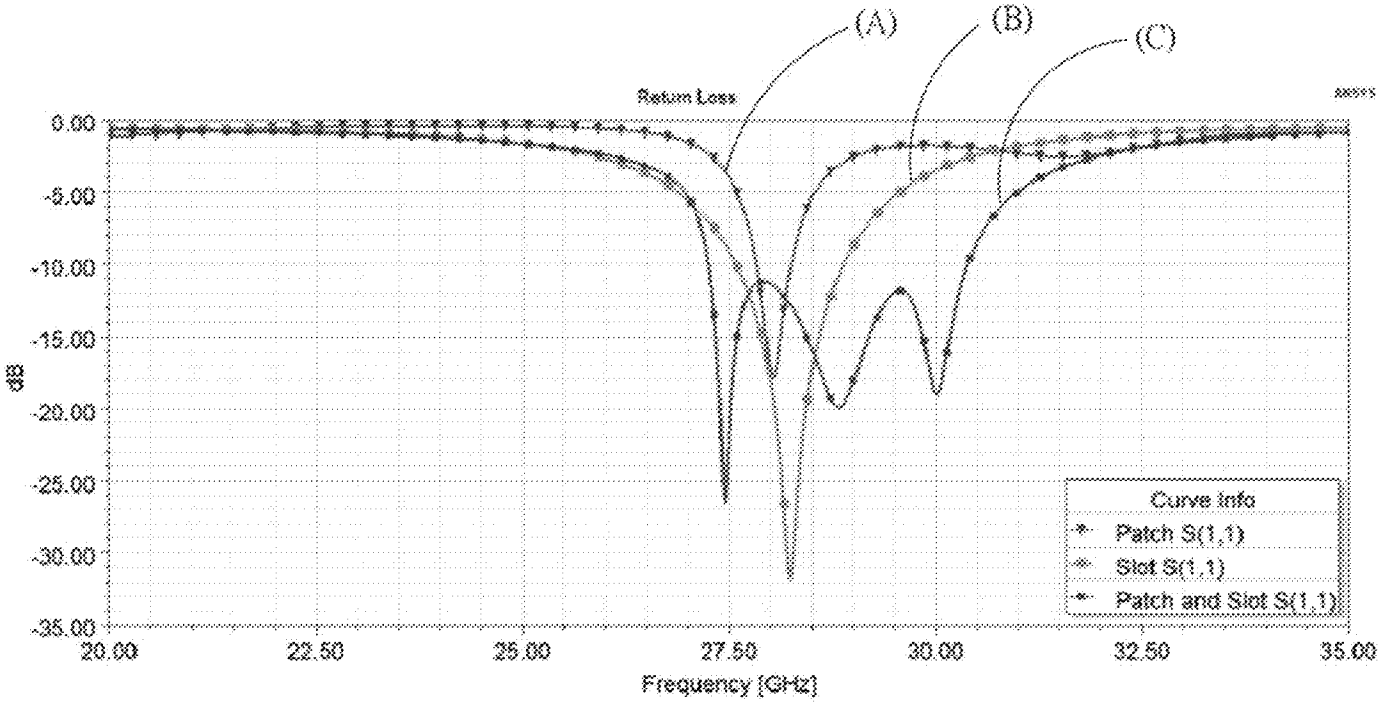
FIG. 3 is a comparison diagram of S parameters of a patch antenna, a slot antenna, and the composite antenna unit of the present invention.

Referring to FIG. 3, the frequency response diagram indicates three modes in 28 GHz antenna design: a patch antenna 110, a slot antenna 130, and a composite antenna unit 100. While a single patch antenna (A) or a single slot antenna (B) has only one frequency response mode, the composite antenna of the present invention (C) has three frequency response modes. In the present invention, the patch antenna 110 and the slot antenna 130 are combined, not only the frequency response mode is increased from one to three, the bandwidth is also significantly wider.

Figure 4:
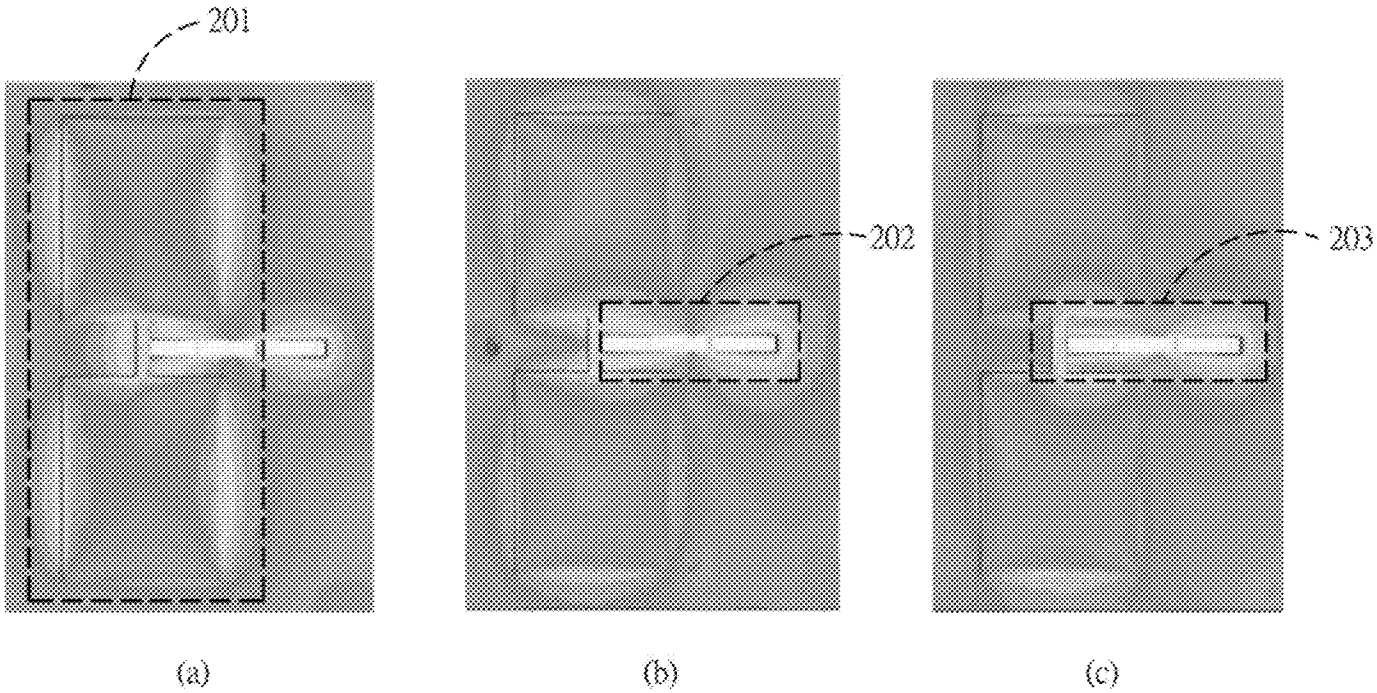
FIG. 4 is a current distribution diagram of three modes of the composite antenna unit according to the present invention.

Referring to FIG. 4, the current distribution diagram indicates resonating positions of the three frequency response modes of the composite antenna unit 100. The first mode 201 at a frequency of 27.45 GHz (as shown (a) in FIG. 4) is from the patch antenna 110 in the first layer, the second mode 202 at a frequency of 28.80 GHz (as shown (b) in FIG. 4) is from the slot antenna 130 in the second layer, and the third mode 203 at a frequency 30.02 GHz (as shown (c) in FIG. 4) is from the coupling path between the patch antenna unit 111 of the patch antenna 110 in the first layer and the slot 132 of the slot antenna 130 in the second layer.

Figure 5:
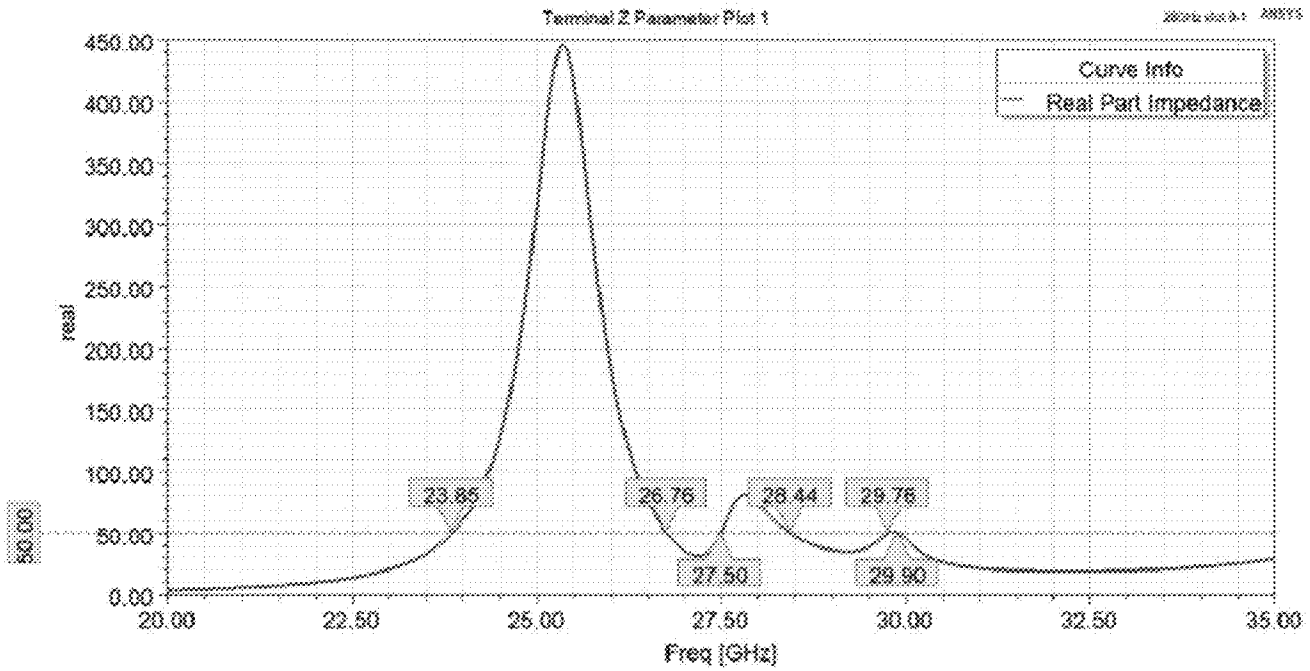
FIG. 5 is a real part impedance diagram of the composite structure of the composite antenna unit according to the present invention.

Referring to FIG. 5, the frequency response diagram indicates that real part impedances at the frequency 28 GHz are all about 50Ω for the composite antenna unit 100 including the patch antenna 110 and the slot antenna 130. The antenna impedance and the feed impedance match each other desirably, so that internal reflection of energy in the antenna is reduced.

Figure 6:
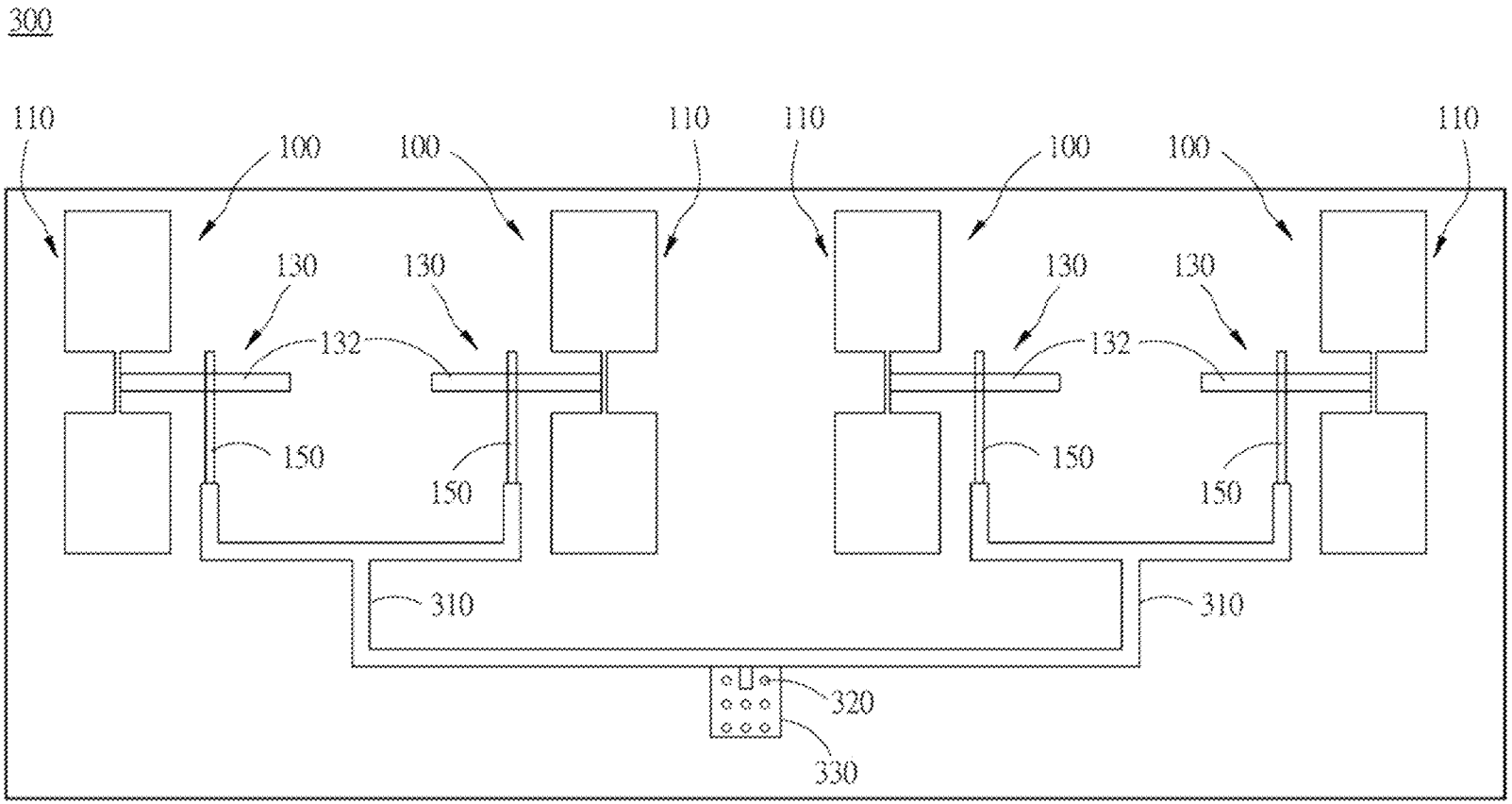
FIG. 6 shows a composite structure and a stacked diagram of the antenna unit in a form of an array according to the present invention.

FIG. 6 shows another embodiment of the composite antenna of the present invention which the antenna gain is further increased. The antenna is designed in the form of an array. In this embodiment, the composite array antenna 300 includes a 1×4 array using 4 composite antennae 100. This 1×4 array antenna utilizes LCP materials and has an overall thickness of 400 μm. Same as the foregoing composite antenna unit 100, this antenna architecture is disposed in a first layer, a second layer, and a third layer. This 1×4 array antenna has an operation frequency band in a range of 27.4 GHz to 30 GHz.

The feed network 310 of the 1×4 array antenna in this embodiment is a 1-to-4 feed network 310, and is disposed in the same third layer as the transmission line 150. In other embodiments of the present invention, the number of arrayed antenna may be other numbers such as 1×6, 1×8 or other numbers are also possible. The feed network 310 is adapted accordingly.

The metal layer 131 of the slot antenna 130 is used as a reference ground (a grounding layer). A plurality of blind holes 320 are formed on the second substrate 140 to allow coupling between the metal layer and the feed network 310. A metal surface 330 is disposed in the third layer where the metal surface 330 is used as an extension of the reference ground. The feeding route may be changed from dimensional to planar, and the feed point may be adapted according to requirements for the feed.

In this embodiment, the antenna is connected to the 1×4 feed network 310. The feed point and the reference ground need to be designed on the same plane due to measurement requirements. The reference ground is connected to the third layer from the second layer through the blind holes 320, and a metal surface 330 is connected to the blind holes on the third layer as an extension of the reference ground, so that to the need to measure planar feed in actual antenna may be achieved.

The array antenna 300 in this embodiment utilizes a liquid crystal polymer (LCP) substrate. The LCP material has a relatively low loss and does not deformed easily due to a relatively low water absorption.

Figure 7:
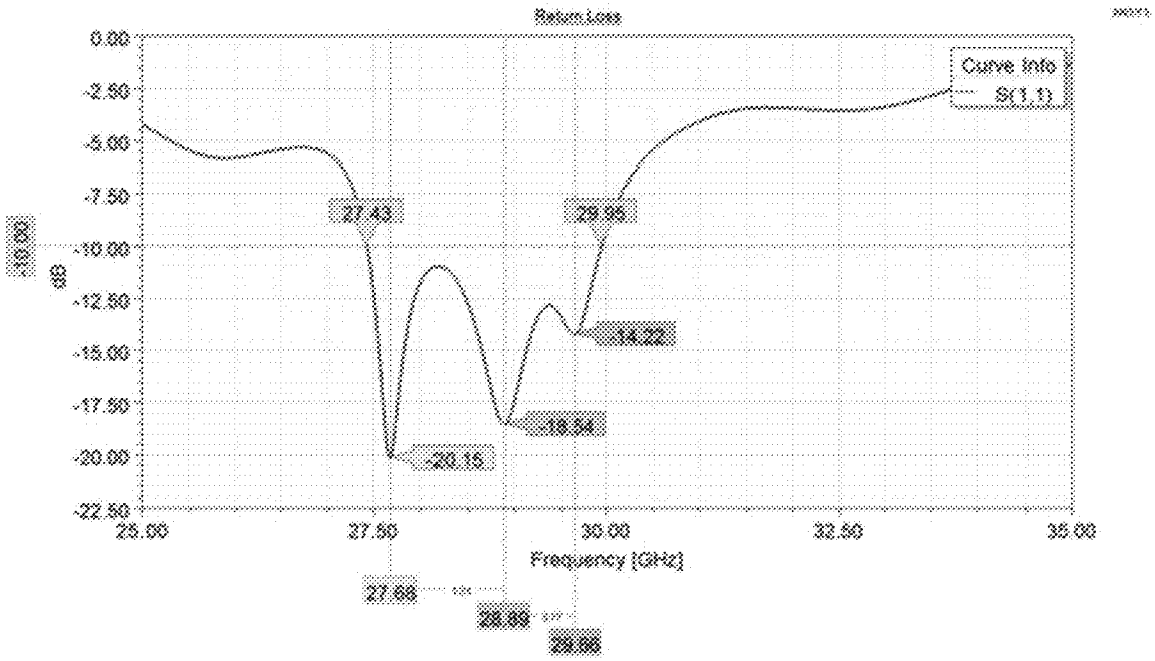
FIG. 7 is a frequency response diagram of the antenna unit according to the present invention in a form of an array.
Figure 8:
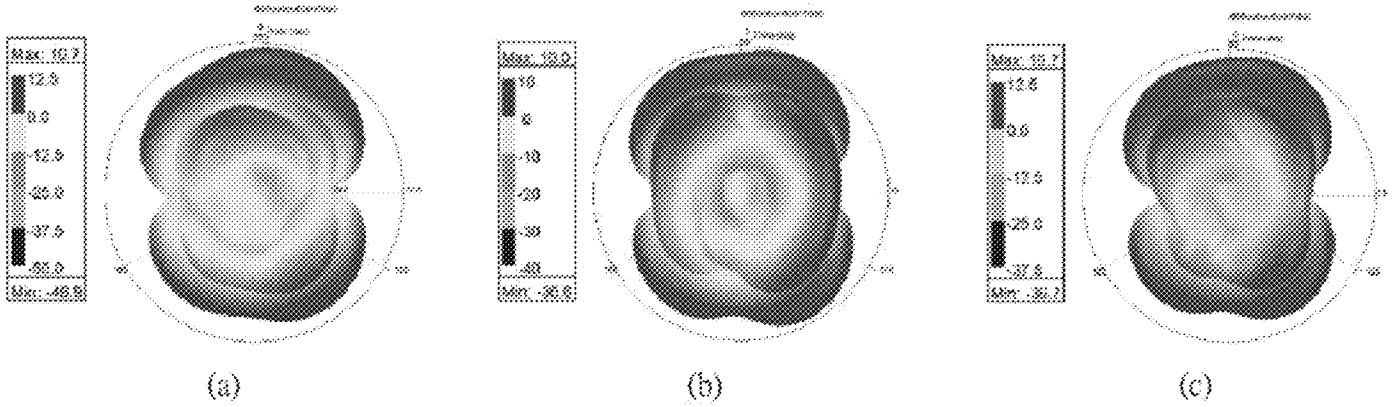
FIG. 8 is a 3D field radiation pattern of antenna gains of the antenna unit according to the present invention in three modes in a form of an array.

FIG. 7 is a frequency response diagram of the array antenna 300 with a 1×4 array according to the present invention. Its antenna frequency band has three modes, and an increased bandwidth as described previously. The antenna has a center frequency of 28.69 GHz, a bandwidth of 8.78%, and a desirable return loss. A gain of the array antenna can reach 10.7 dBi, as shown in FIG. 8: (a) 27.68 GHz, (b) 28.89 GHz, and (c) 29.66 GHz.

In conclusion, according to the present invention, the composition antenna unit utilizes the composite architecture including the patch antenna and the slot antenna where the patch antenna and the slot antenna respectively resonates at half the wavelength. The present invention alleviates the problem of an excessively small bandwidth of single patch antenna or single slot antenna. The antenna has a desirable antenna gain, and a wider antenna bandwidth compared to existing single patch or slot antenna.

The present invention further provides an array antenna ranged from 27.4 GHz to 30 GHz by using a plurality of above mentioned composition antennas. The arrayed antenna has a center frequency of 28.69 GHz, a bandwidth of 8.78%, and a desirable return loss. A gain of the array antenna can reach 10.7 dBi. The composition antenna and array utilizes liquid crystal polymer (LCP) substrate for its low loss and low water absorption characteristics that are desirable in millimeter wave antenna design.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A composite antenna unit, comprising:

a first substrate, having an upper surface and a lower surface opposite to the upper surface;

a patch antenna, disposed on the upper surface of the first substrate, wherein the patch antenna resonates at half a wavelength;

a second substrate, having an upper surface, a lower surface opposite to the upper surface, and a blind hole used as a feed point;

a slot antenna, formed by providing a slot in a metal layer disposed between the lower surface of the first substrate and the upper surface of the second substrate, wherein the slot antenna resonates at half the wavelength; and a transmission line, disposed on the lower surface of the second substrate, wherein the transmission line corresponds to the blind hole and is configured to couple a signal feed to the slot antenna, wherein the entire composite antenna unit satisfies a resonance condition through coupling; a signal is fed through the transmission line and coupled to the slot antenna, and the signal from the slot antenna is further coupled to the patch antenna.

2. The composite antenna unit according to claim 1, wherein the slot of the slot antenna is substantially perpendicular to the direction of the transmission line.

3. The composite antenna unit of claim 1, wherein the patch antenna consists of two patch antenna units resonating at half the wavelength and a line segment connecting the two patch antenna units, wherein a position of the line segment is aligned with an edge in the slot of the slot antenna.

4. The composite antenna unit of claim 3, wherein each of the patch antenna units has shapes of a square, a rectangle, a circle, an oval, a triangle, a sector, a ring, a ring sector or other similar shapes.

5. The composite antenna unit of claim 1, wherein the transmission line and the slot antenna are coupled at a position 0.26 times the wavelength distant from the center of the slot.

6. The composite antenna unit of claim 1, wherein the first substrate and the second substrate are made of liquid crystal polymer (LCP).

7. An array antenna, comprising an arrayed plurality of antennae using the composite antenna units of claim 1.

8. The array antenna of claim 7, wherein the slot of the slot antenna is substantially perpendicular to the direction of the transmission line.

9. The array antenna of claim 7, wherein the patch antenna consists of two patch antenna units resonating at half the wavelength and a line segment connecting the two patch antenna units, wherein a position of the line segment is aligned with an edge in the slot of the slot antenna.

10. The array antenna of claim 7, wherein each of the patch antenna units has shapes of a square, a rectangle, a circle, an oval, a triangle, a sector, a ring, a ring sector or other similar shapes.

11. The array antenna of claim 7, wherein the transmission line and the slot antenna are coupled at a position 0.26 times the wavelength distant from the center of the slot.

12. The array antenna of claim 7, wherein the first substrate and the second substrate are made of liquid crystal polymer (LCP).

13. The array antenna of claim 7, wherein the arrayed antenna has an overall thickness of 400 μm and an operation frequency band ranged from 27.4 GHz to 30 GHz.

14. The array antenna of claim 7, wherein the arrayed antenna includes a feed network in the same layer as the transmission line, and the feed network is a one-to-many feed network.

15. The array antenna of claim 14, wherein the metal layer of the slot antenna is used as a reference ground, a plurality of blind holes are formed on the second substrate to allow coupling between the metal layer and the feed network, and a metal surface is disposed on the same layer as the feed network to serve as an extension of the reference ground.

* * * * *